US007086901B2

(12) United States Patent
Zhang

(10) Patent No.: US 7,086,901 B2
(45) Date of Patent: Aug. 8, 2006

(54) SHIELDED ELECTRICAL CONNECTOR

(75) Inventor: Guozeng Zhang, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/927,666

(22) Filed: Aug. 27, 2004

(65) Prior Publication Data

US 2005/0048839 A1 Mar. 3, 2005

(30) Foreign Application Priority Data

Aug. 27, 2003 (CN) ..... 03 2 78203

(51) Int. Cl.
*H01R 13/648* (2006.01)

(52) U.S. Cl. ..... 439/607; 439/541.5

(58) Field of Classification Search ..... 439/607–610, 439/101, 108, 502–504, 541.5, 79, 350–358
See application file for complete search history.

(56) References Cited

U.S. PATENT DOCUMENTS

| | | | | |
|---|---|---|---|---|
| 5,362,249 | A | 11/1994 | Carter | |
| 6,155,872 | A * | 12/2000 | Wu | 439/541.5 |
| 6,238,244 | B1 * | 5/2001 | Yang | 439/607 |
| 6,264,504 | B1 * | 7/2001 | Wu | 439/607 |
| 6,280,209 | B1 | 8/2001 | Bassler et al. | |
| 6,347,961 | B1 * | 2/2002 | Zhu et al. | 439/607 |
| 6,447,311 | B1 | 9/2002 | Hu et al. | |
| 6,793,531 | B1 * | 9/2004 | Zhang | 439/607 |
| 6,863,549 | B1 * | 3/2005 | Brunker et al. | 439/108 |

* cited by examiner

*Primary Examiner*—Truc T. Nguyen
*Assistant Examiner*—Edwin A. Leon
(74) *Attorney, Agent, or Firm*—Wei Te Chung

(57) ABSTRACT

An electrical connector includes an insulative housing (1), a number of terminals (5) received in the housing, an inner shield (2), an outer shield (3), a spacer (4) and a rear shield (6). The insulative housing includes a base portion (13), a pair of parallel tongues (111,112) extending forwardly from the base portion, and a number of passageways (12) defined in respective tongues for receiving the terminals. The inner shield substantially encloses the tongues and includes a number of tabs (24, 25, 26) formed on side walls (21), a top wall (22) and a bottom wall (23) thereof, respectively. Each tab extends outwardly from the walls of the inner shield for electrically contacting with a shielding means of a mating complementary connector.

18 Claims, 5 Drawing Sheets

SHIELDED ELECTRICAL CONNECTOR

BACKGROUND OF THE INVENTION

1. Field of the Invention

The present invention generally relates to an electrical connector, and particularly to an electrical connector for high-speed data transmission application connector.

2. Description of Prior Arts

With the development of communication and computer technology, electrical connectors for high-speed data transmission are widely used in electronic systems. As the speed and distance of the data transmission increases, Electro Magnetic Interference (EMI) becomes an important issue. Conventionally, high-speed data transmission connector always employs a metallic shield for avoiding EMI.

U.S. Pat. No. 6,280,209 and U.S. Pat. No. 5,362,249 both disclose electrical connectors defining a shield. The shield comprises a plurality of tabs provided on the two side walls. The tabs are used for electrically connecting with a shielding means of a mating complementary connector to thereby establish a grounding trace therebetween. However, the electrical connecting area between the shield and the shielding means of the complementary connector is not sufficient and only concentrates on the two sides of the shield and the shielding means of the complementary connector, so that the electrostatic charge cannot be discharged adequately as soon as possible. Furthermore, after repeated insertions of the complementary connector, it is probable that the tabs become loosen and cannot establish a reliable electrical connection between the shield and the shielding means of the complementary connector.

Hence, it is desirable to have an improved electrical connector to overcome the above-mentioned disadvantages of the prior art.

BRIEF SUMMARY OF THE INVENTION

Accordingly, it is an object of the present invention to provide an electrical connector having shielding means that can protect the connector from EMI effectively.

In order to achieve the above-mentioned object, an electrical connector in accordance with the present invention includes an insulative housing, a plurality of terminals, an inner shield and an outer shield. The insulative housing includes a base portion, a pair of parallel tongues extending forwardly from the base portion, and a number of passageways defined in respective tongues for receiving the terminals. The inner shield substantially encloses the tongues to form a first mating space and has tabs extending outwardly from two side walls, a top wall and a bottom wall thereof. The outer shield encloses both the inner shield and the insulative housing and extends forwardly with a second mating space being defined between the inner shield and the outer shield. A mating portion of the complementary connector is received in the first and the second mating space.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
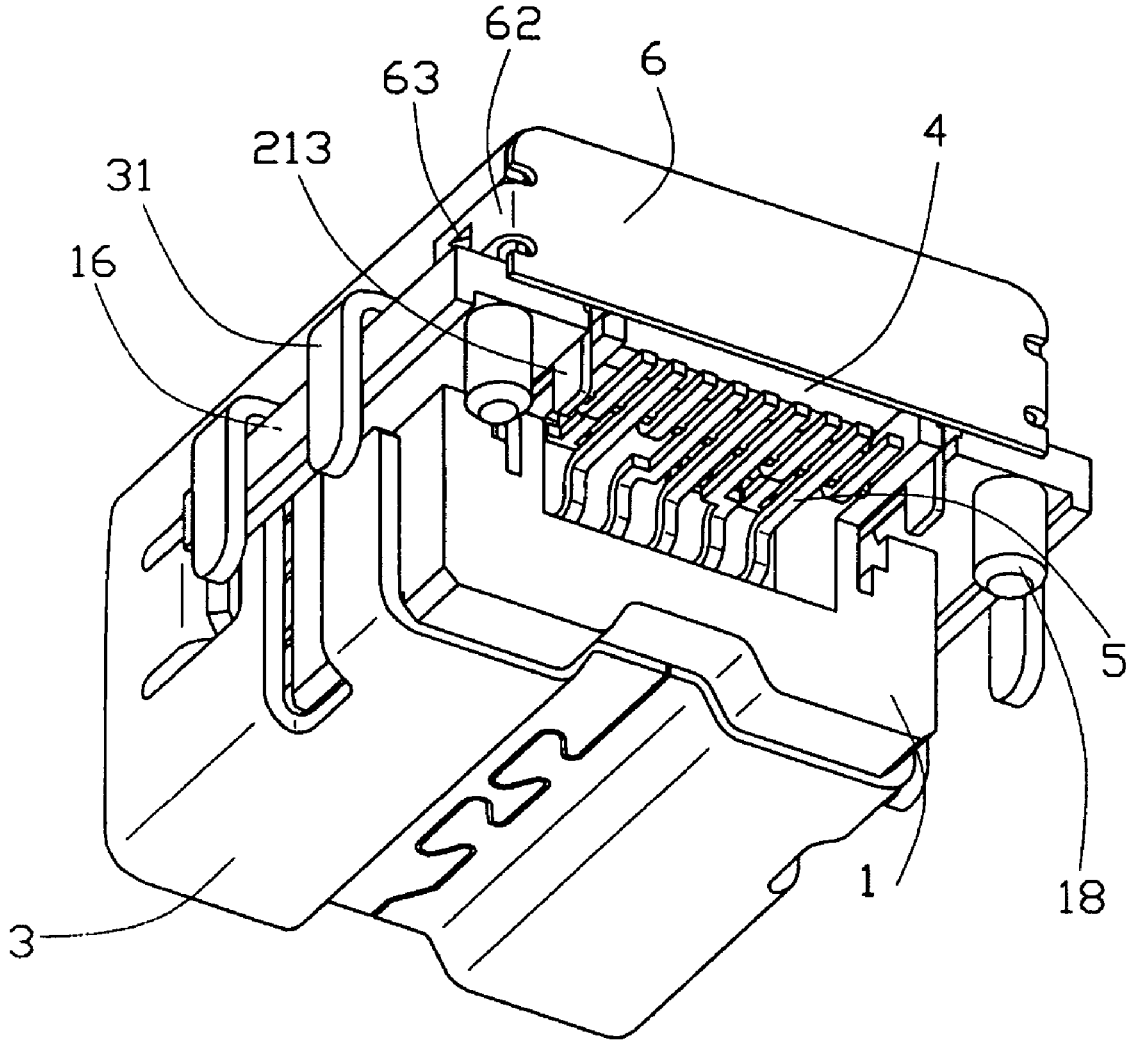
FIG. 1 is a perspective view of an electrical connector in accordance with the present invention.

Reference will now be made to the drawing figures to describe the present invention in detail.

Figure 2:
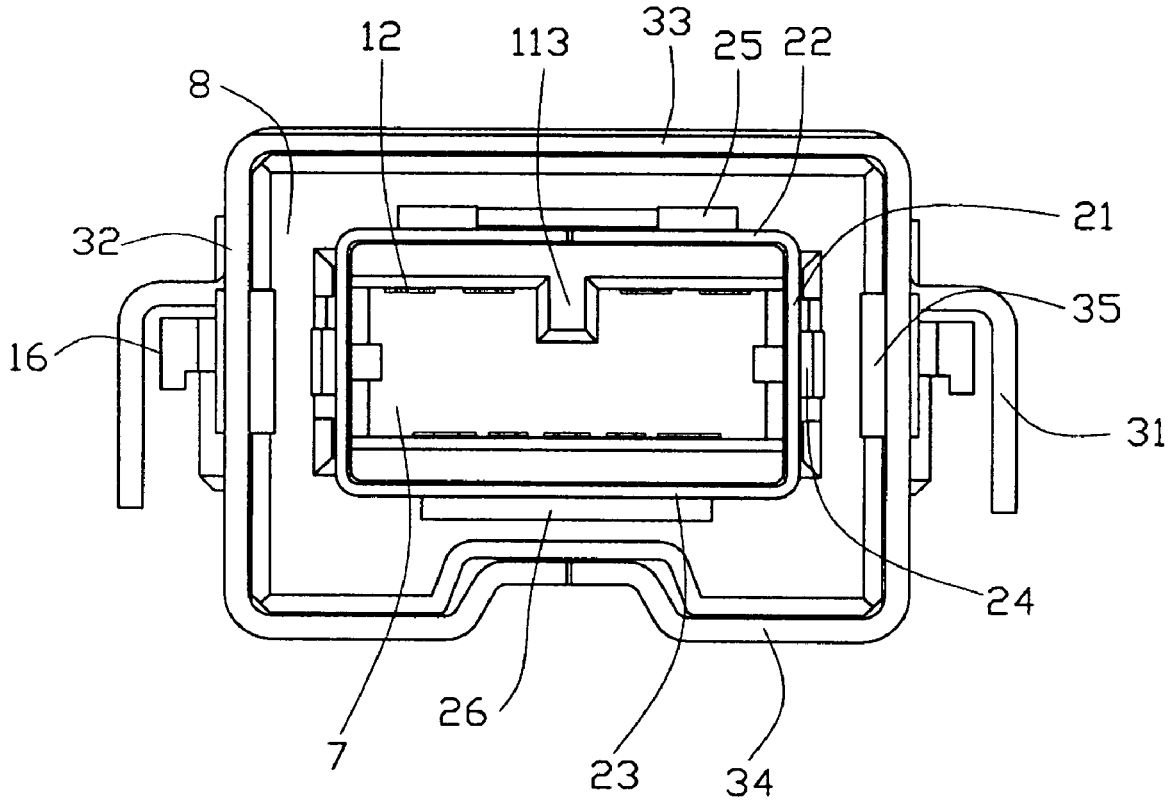
FIG. 2 is a front view of the electrical connector shown in FIG. 1.
Figure 3:
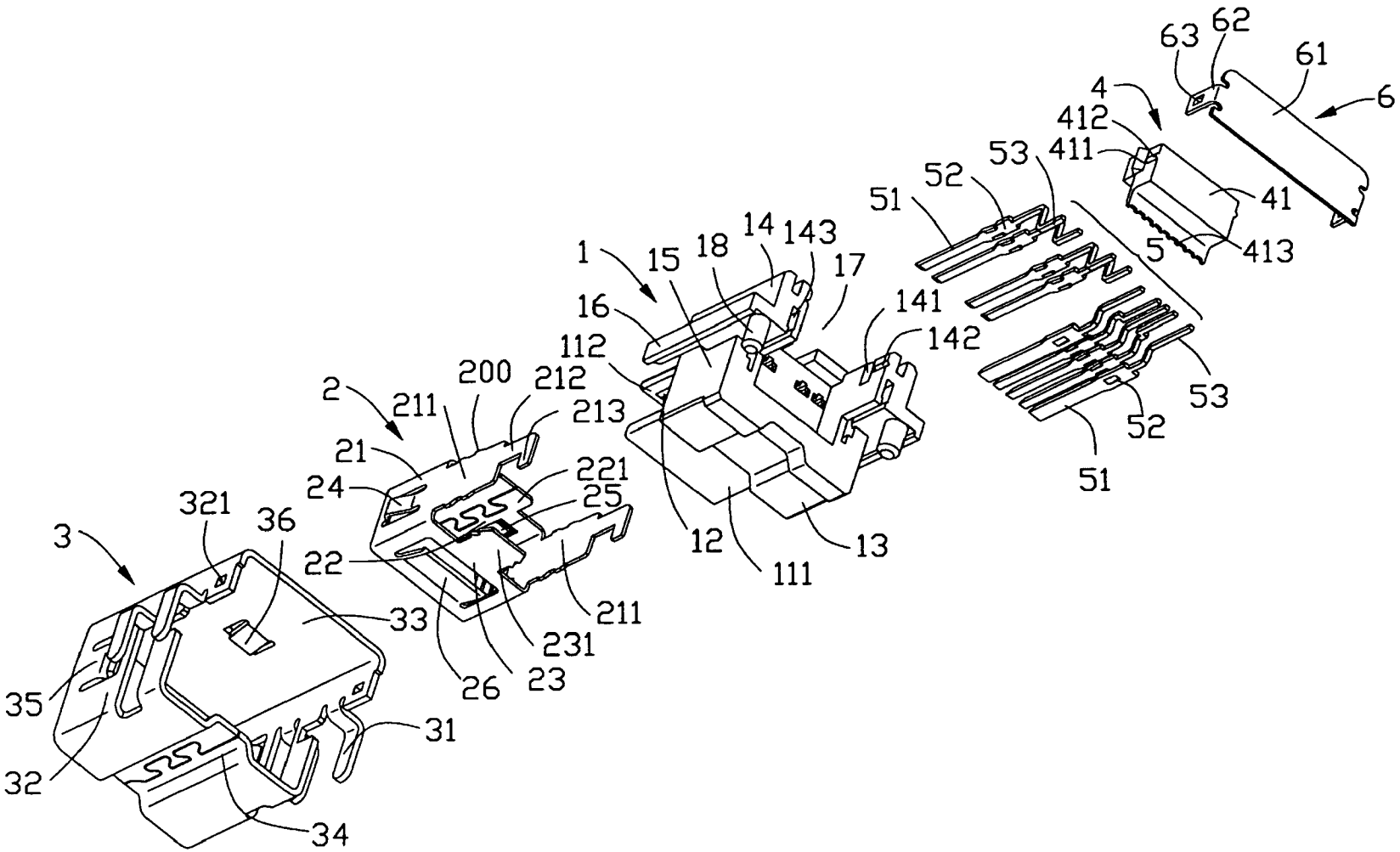
FIG. 3 is an exploded, perspective view of the electrical connector.

With reference to FIGS. 1–3, an electrical connector in accordance with the present invention for high-speed data transmission comprises an insulative housing 1, a plurality of terminals 5, an inner shield 2, an outer shield 3, a spacer 4 and a rear shield 6.

The insulative housing 1 comprises a base portion 13, a first and a second tongues 111, 112 extending horizontally and forwardly from the base portion 13. A plurality of passageways 12 are defined in respective inner faces of the first tongue 111 and the second tongue 112 and extends though the base portion for receiving the corresponding terminals 5. A rib 113 (FIG. 2) is defined at the center of the second tongue 112 and extends toward the first tongue 111 for guiding a complementary connector (not shown). A frame portion 15 extends rearwardly from the base portion 13. A pair of first arms 14 project upwardly and rearwardly from the frame portion 15, and each defines a vertical slot 141 and a horizontal slot 142 in respective inner faces thereof. A receiving space 17 is defined between the first arms 14 for receiving the spacer 4. A pair of slits 143 extend forwardly from opposite rear ends of the first arms 14 through the base portion 13. Each first arm 14 has a post 18 projecting from a bottom face thereof. A pair of second arms 16 extend outwardly from the opposite sides of the frame portion 15.

The terminals 5 are arranged in an upper row and a lower row. Each terminal 5 comprises a contacting portion 51 received in the corresponding passageway 12 of the first and the second tongue 111, 112 for electrically connecting with corresponding terminals of the complementary connector, a retention portion 52 extending rearwardly from the contacting portion 51 for retaining the terminal 5 in the corresponding passageways 12 of the base portion 13, and an L-shape engaging portion 53 extending rearwardly from the retention portion 52 for soldering on a printed circuit board (not shown).

Figure 4:
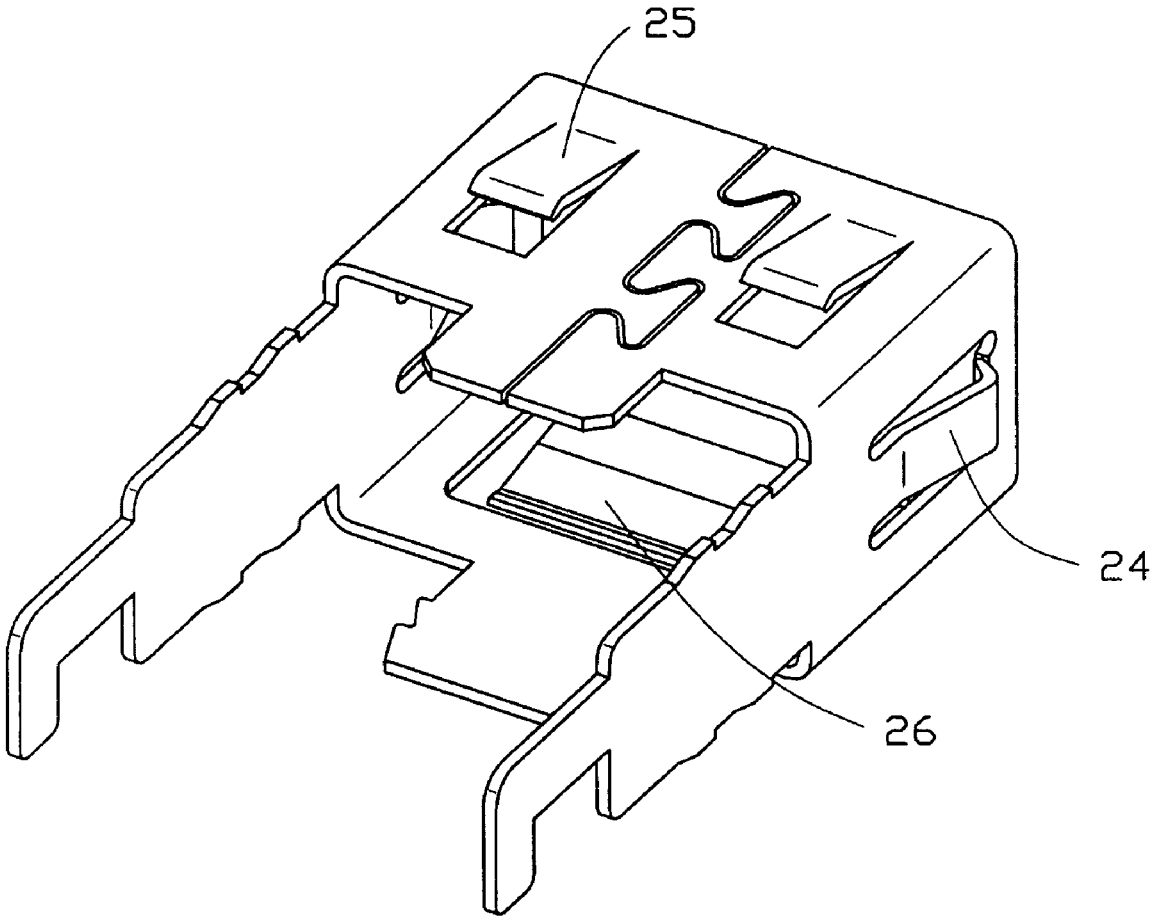
FIG. 4 is an enlarged, perspective view of an inner shield of the electrical connector.
Figure 5:
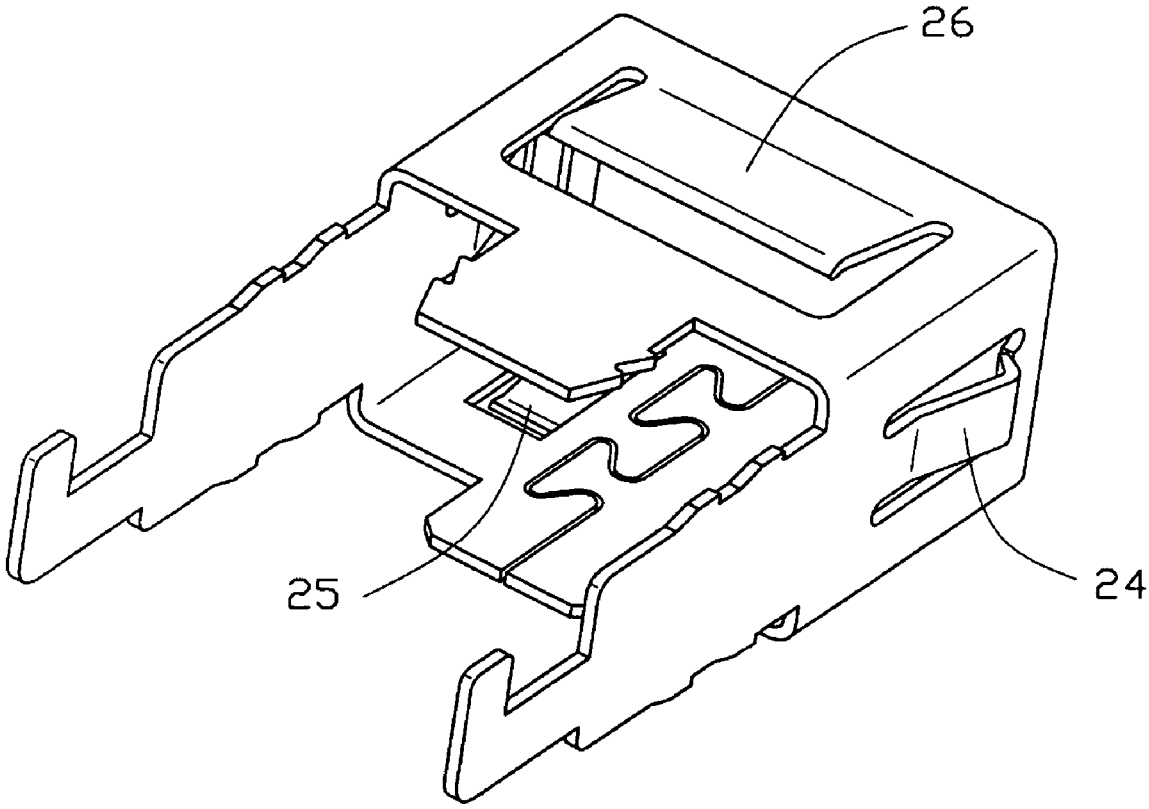
FIG. 5 is a view similar to FIG. 4 but taken from a different perspective.

The inner shield 2 and the outer shield 3 are respectively made of a piece of metal sheet. The inner shield 2 substantially encloses the first and the second tongues 111, 112, and comprises a pair of side walls 21, a top wall 22 and a bottom wall 23 (FIG. 4 and FIG. 5). A pair of tabs 24 extend outwardly from the side walls 21, another pair of tabs 25 extend outwardly from the top wall 22 and a tab 26 extends outwardly from the bottom wall 23. Each side wall 21 comprises a retaining plate 221 extending rearwardly therefrom, and the top wall 22 and the bottom wall 23 each comprise a retaining plate 221, 231 extending rearwardly therefrom respectively. A plurality of protrusions 200 are formed on the retaining plates 211, 231 for firmly securing the inner shield 2 on the housing 1. A pair of tail portions 212 extend rearwardly from the retaining plates 211 of the opposite side walls 21 for being received in the corresponding slits 143 of the first arms 14. Distal ends of the tail portions 212 each comprise a grounding finger 213 extending downwardly.

The outer shield 3 encloses the base portion 13 of the insulative housing 1 and comprises a pair of side walls 32, a top wall 33 and a bottom wall 34. A pair of locking holes 321 are respectively defined at rear ends of the side walls 32, which are adjacent to the top wall 33. A plurality of grounding plates 31 extend downwardly from the side walls 32. The outer shield 3 comprises a pair of spring pads 35 extending inwardly from the side walls 32 and a spring pads 36 extending inwardly from the top wall 33. The spring pads 35 and the tabs 24 are used in electrically connecting with the shielding means of the mating complementary connector and guiding the mating complementary connector. A retention tab 36 extends inwardly from the top walls 33.

The spacer 4 comprises a rectangular base 41 and a first and a second locking blocks 411,412 extending from each of opposite sides of the base 41. The first locking block 411 is used in engaging with the corresponding vertical slot 141 of the first arm 14, and the second locking block 412 is used in mating with the corresponding horizontal slot 142, so that the spacer 4 is reliably positioned in the receiving space 17. The base 41 of the spacer 4 has a plurality of projections 413 formed at a bottom edge thereof for positioning the engaging portions 53 of the terminals 5.

The rear shield 6 comprises a planar main body 61, a pair of retention arms 62 extending from opposite ends of the main body 61 and a locking tab 63 formed on each retention arm 62. The locking tabs 63 are configured to be received in the locking holes 321 of the outer shield 3 to assemble the rear shield 6 with the outer shield 3. It should be noted here that the rear shield 6 may also be formed integrally with the outer shield 3 in other embodiment.

During assembly, the terminals 5 are assembled to the insulative housing 1 from the rear end to the front end of the insulative housing 1. A first mating space 7 is defined among the tongues 111,112 and the side walls 21 of the inner shield 2 for receiving the complementary connector. The protrusions 200 of the retaining plates 211,231 engage with the insulative housing 1 to retain the inner shield 2 thereon. Distal ends of the grounding fingers 213 extend downwardly below the bottom faces of the first arms 14. The spacer 4 is inserted into the receiving space 17. The engaging portions 53 of the terminals 5 are positioned between the projections 413 of the spacer 4. The outer shield 3 is assembled to the insulative housing 1 with the bottom wall 34 of the outer shield 3 abutting against the frame portion 15 of the insulative housing 1 and encloses the base portion 13. A second mating space 8 is defined between the outer shield 3 and the inner shield 2. The rear shield 6 is assembled to the outer shield 3.

With reference to FIG. 1, the tabs 24, 25, 26 of the inner shield 2 extend partially received into the second mating space 8. Because the tabs 24, 25, 26 extend from not only two side walls 21 of the inner shield 2 but also the top wall 22 and the bottom wall 23, the contacting area between the inner shield 2 and the shielding means of the complementary connector is substantially increased, so that the electrostatic charge can be discharged adequately as soon as possible. A reliable electrical connection between the inner shield and the shielding means of the complementary connector is thus established.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. At electrical connector comprising:

an insulative housing comprising a base portion, a pair of tongues extending forwardly from the base portion and a plurality of passageways defined in the tongues and extending though the base portion;

a plurality of terminals received in the passageways;

an inner shield enclosing the tongues of the insulative housing, the inner shield integrally having an upper wall, a lower wall and a pair of side walls and defining a first mating space therebetween for receiving a mating portion of a complementary connector, the inner shield comprising a pair of tabs on the side walls, a pair of tabs on the upper wall and a tab extending outwardly from the lower wall;

an outer shield substantially enclosing the insulative housing and the inner shield, the outer shield defining a second mating space for receiving another portion of the complementary connector; and wherein the insulating housing comprises a pair of arms extending from the base portion.

2. The electrical connector as described in claim 1, wherein the tabs all extend outwardly and are partially received in the second mating space.

3. The electrical connector as described in claim 1, further comprising a third shield, wherein the shield comprises a planar main body, a pair of retention anus extending from opposite ends of the main body and a locking portion on each retention arm, and wherein the outer shield defines a pair of locking holes receiving the locking portions of the third shield.

4. The electrical connector as described claim 1, wherein the outer shield comprises at least one grounding plate extending therefrom.

5. The electrical connector as described claim 1, wherein each terminal comprises a contacting portion, a retention portion extending from the contacting portion and an engaging portion connecting to the retention portion.

6. The electrical connector as described in claim 1, wherein the inner shield comprises a pair of retaining plates extending rearwardly from the side walls and a retaining plate extending from the upper wall and the lower wall respectively, the retaining plates being retained onto the housing.

7. The electrical connector as described in claim 6, wherein the inner shield comprises a pair of tail portions extending rearwardly therefrom, and each tail portion has a grounding finger extending downwardly therefrom.

8. The electrical connector as described in claim 7, wherein the insulative housing comprises a pair of slits extending forwardly from opposite rear ends of the arms and through the base portion and wherein the grounding fingers of the inner shield extend through corresponding slits.

9. The electrical connector as described in claim 1, wherein the insulative housing defines a space between the pair of arms.

10. The electrical connector as described in claim 9, further comprising a spacer received in the space of the insulative housing, the spacer comprising a base and a plurality of projections extending from the base for arranging the terminals.

11. The electrical connector as described in claim 10, wherein the pair of arms of the insulative housing each define a vertical slot and a horizontal slot, and wherein the base of the spacer comprises a pair of blocks on opposite sides thereof for engaging within corresponding slots.

12. An electrical connector comprising:

an insulative housing comprising a base portion, at least one tongue extending forwardly from the base portion and a plurality of passageways defined in the tongue and extending through the base portion;

a plurality of terminals received in the passageways;

an inner shield enclosing the tongues of the insulative housing, the inner shield integrally having an upper wall, a lower wall and a pair of side walls and defining a first mating space for receiving a portion of a complementary connector, the inner shield defining at least one resilient tab thereon;

an outer shield substantially enclosing the inner shield, a space defined between the inner shield and the outer shield for receiving anther portion of the complementary connector; wherein said outer shield defines a tab facing toward and aligned with the corresponding resilient tab of the inner shield in a vertical direction perpendicular to a mating direction; wherein the housing further comprises a pair of arms extending from the base portion.

13. The electrical connector as described claim 12, wherein the inner shield has a pair of retaining plates extending from said side walls and retained in corresponding arms.

14. The electrical connector as described claim 13, wherein the outer shield has a pair of side walls, each of which has a portion sandwiched between the base portion and the arm.

15. An electrical connector comprising:

an insulative housing comprising a base portion, at least one tongue extending forwardly from the base portion and a plurality of passageways defined in the tongue and extending though the base portion; the housing defining a mounting face on a rear portion thereof which is essentially located in a middle level of the housing in a vertical direction;

a plurality of terminals received in the passageways;

an inner shield enclosing die tongues of the insulative housing, the inner shield integrally having an upper wall, a lower wall and a pair of side walls and defining a first mating space for receiving a portion of a complementary connector; and an outer shield substantially enclosing the inner shield, a space defined between the inner shield and the outer shield for receiving another portion of the complementary connector; wherein the housing defines a through slot extending along a front-to-back direction to allow the inner shield to extend therethrough from a front face of the housing during assembling and have a grounding finger exposed outside of the rear portion of the housing around said mounting face, for mounting to a printed circuit board on which the housing is seated upon.

16. The connector as claimed in claim 15, wherein said outer shield includes a grounding plate, for mounting to the printed circuit board, exposed to an exterior around said mounting face and located outside of the grounding finger in a transverse direction perpendicular to said front-to-back direction.

17. The connector as claimed in claim 16, wherein both said grounding finger and said grounding plate extend downwardly.

18. The connector as claimed in claim 16, wherein a mounting post integrally extends downwardly from the housing and is located between said grounding finger and said grounding plate.

* * * * *